US005401017A

United States Patent [19]

McDonald et al.

[11] Patent Number: 5,401,017

[45] Date of Patent: Mar. 28, 1995

[54] TRAINING AID TO CONTROL WRIST MOVEMENT

[76] Inventors: Robert A. McDonald, 8815 Richmond Ave., Baltimore, Md. 21234; Thomas Gross, 445 Monument Rd., Apt. 112, Jacksonville, Fla. 32225

[21] Appl. No.: 207,842

[22] Filed: Mar. 8, 1994

[51] Int. Cl.[6] ..... A63B 69/36; A63B 69/00

[52] U.S. Cl. ..... 273/26 C; 273/189 R

[58] Field of Search ..... 273/187.2, 189 R, 189 A, 273/26 C, 54 B

[56] References Cited

U.S. PATENT DOCUMENTS

| | | | |
|---|---|---|---|
| 3,350,100 | 10/1967 | Carmines | 273/187.2 |
| 3,400,934 | 9/1968 | Muehl | 273/189 |
| 3,865,383 | 2/1975 | Clay et al. | 273/187.2 |
| 4,017,086 | 4/1977 | Washburn | 273/187.2 |
| 4,088,318 | 5/1978 | Massman | 273/187.2 |
| 4,245,841 | 1/1981 | Owens, Jr. | 273/187.2 |
| 5,048,837 | 9/1991 | Manley et al. | 273/187.2 |
| 5,158,298 | 10/1992 | Goins | 273/187.2 |
| 5,207,430 | 5/1993 | Goins | 273/189 R |

*Primary Examiner*—George J. Marlo
*Attorney, Agent, or Firm*—Leonard Bloom

[57] ABSTRACT

A training aid for persons using a hand-held sporting implement which strikes a ball. The training aid controls the bending of the wrist. The training aid includes a housing which is removably secured to the person's wrist and forearm. A sliding latch is formed in the housing and is removably restrained in the housing. A member is pivotally attached to the housing. An opening to receive the thumb is formed in the pivotally attached member. A bowed connector connects the pivotally attached member to the sliding latch. When the training aid is mounted on the person's wrist and forearm and the person holds the sporting implement in a position to swing the sporting implement, the bowed connector restrains movement of the pivotally attached member and restrains uncocking of the wrist. When the person swings the sporting implement close to impact with the ball, the wrist uncocks and pulls the bowed connector to release the sliding latch.

6 Claims, 5 Drawing Sheets

TRAINING AID TO CONTROL WRIST MOVEMENT

FIELD OF THE INVENTION

The present invention relates to a training aid to control the movement of the wrist of a person and in particular to an aid worn on the wrist and forearm of the person when the person swings a hand-held sporting implement to strike a ball.

BACKGROUND ART

In several sports where a person holds a sporting implement such as a golf club, a baseball bat or a tennis racket, which is used to strike a ball, the movement of the wrists is a critical factor in the proper swing of the sporting implement. If the wrists bend too soon before the ball is struck, the ball does not receive the maximum possible impact of the sporting implement and as a result, the ball does not travel as far as desired and/or in the direction intended.

Numerous devices have been proposed to assist in the training of persons to swing a golf club and other sports equipment. The applicant is aware of the following U.S. patents which disclose training devices:

| Inventor(s) | U.S. Pat. No. |
|---|---|
| Carmines | 3,350,100 |
| Muehl | 3,400,934 |
| Clay et al | 3,865,383 |
| Washburn | 4,017,086 |
| Massman | 4,088,318 |
| Owens | 4,245,841 |
| Manley et al | 5,048,837 |
| Goins | 5,158,298 |

While these devices have been useful, they have not received wide acceptance by the public and a less complex effective training aid is needed.

SUMMARY OF THE INVENTION

It is an object of the present invention to provide a simple training aid which can be attached to the wrist and forearm of a person and is effective in controlling the bending of the person's wrist when the person swings a hand-held sporting implement such as a golf club, a baseball bat or a tennis racket.

In accordance with the teachings of the present invention, there is disclosed herein a training aid for persons using a hand-held sporting implement which strikes a ball, wherein the bending of the wrists of the person is to be controlled. The training aid includes a housing and strap means connected to the housing for removably and adjustably securing the housing to the wrist and forearm of the person. The housing has a length, a front end and a back end. A longitudinal slot is formed on the housing extending between the front end and the back end. A sliding latch is slidably guided in the longitudinal slot. A stud is formed on the sliding latch and oriented toward the back end of the housing. A socket is formed in the longitudinal slot near the back end of the housing. A rigid bowed connector has a first end and a second end. The first end of the bowed connector is connected to the sliding latch. A member is pivotably attached to the front end of the housing. An opening is formed in the member wherein a thumb of the person's hand may be received in said opening when the housing is secured to the person's wrist and forearm.

A ball socket is carried by the pivotally attached member. The second end of the bowed connector is connected to the ball socket. In this manner, when the training aid is mounted on the person's hand, wrist and forearm and the person holds the sporting implement in a position to swing the sporting implement, the stud is received in the socket and the bowed connector restrains movement of the pivotally attached member in which the thumb is received. Thus, a desired setting of the wrist is obtained. When the person swings the sporting implement the desired setting of the wrist is maintained until the wrist bends and pulls the bowed connector to release the stud from the socket.

These and other objects of the present invention will become apparent from a reading of the following specification, taken in conjunction with the enclosed drawings.

DESCRIPTION OF THE PREFERRED EMBODIMENTS

Figure 1:
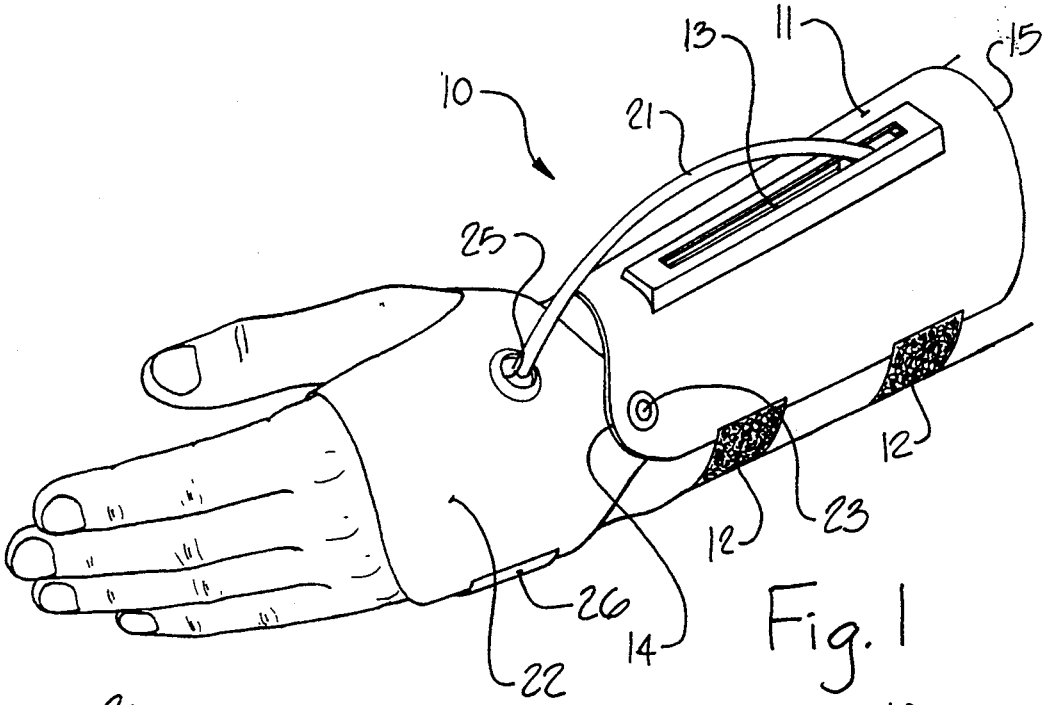
FIG. 1 is a perspective view of the training aid of the present invention mounted on the arm of a person.
Figure 2:
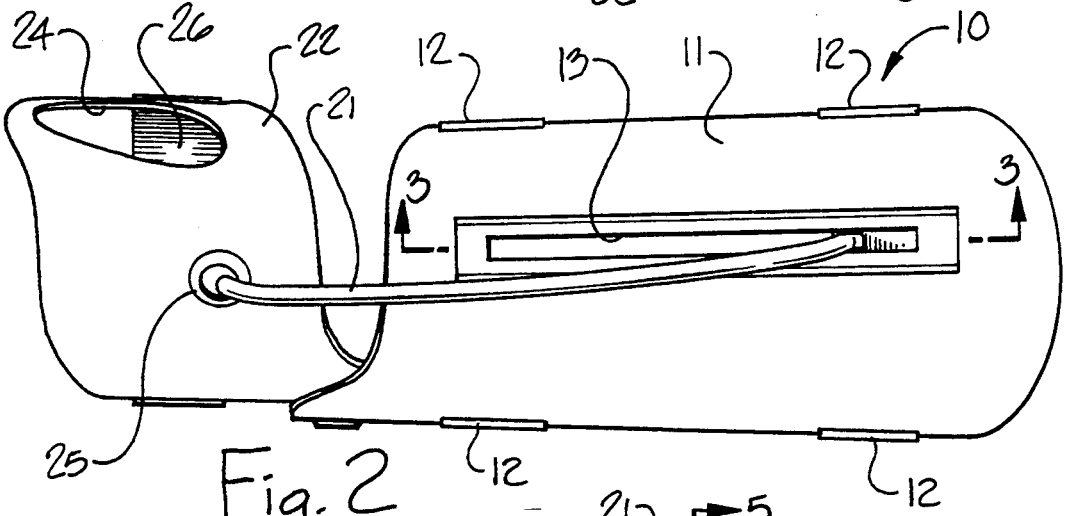
FIG. 2 is a top plan view of the training aid of the present invention.

Referring to FIGS. 1–2, the training aid 10 of the present invention includes a housing 11 which preferably is formed as a curved body or is flexible so as to conform to the wrist and forearm of the person using the training aid 10. Strap means 12 are connected to the housing 11 preferably on opposite sides thereof, to removably and adjustably secure the housing 10 to the forearm and wrist. The strap means 12 may have buckles, snap fasteners, hook and loop fasteners or other selected means to permit connecting of the strap means to one another. It is preferred that two strap means be disposed on each side of the housing diametrically opposite one another to more effectively secure the housing 11 to the forearm and the wrist. A longitudinal slot 13 is formed on the housing 11, the slot 13 extending between the front end 14 and the back end 15 of the housing 11. Alternately, a track having a longitudinal slot 13 is attached to the housing 11. A sliding latch 20 is slidably guided in the longitudinal slot 13. A first end of a rigid bowed connector 21 is connected to the sliding latch 20. A member 22 is attached at a pivot 23 to the front end 14 of the housing 11. The member 22 has an opening 24 formed therein, the person's thumb being received in the opening 24 when the housing 11 is secured to the person's wrist and forearm. A swivel connecting means 25 is attached to the pivotally attached member 22 and a second end of the bowed connector 21 is connected to the swivel connecting means 25. The swivel connecting means 25 may be a ball socket or other means to permit free rotation of the second end of the bowed connector 21. A strap or elastic band 26 may be attached to the member 22 extending between near the thumb opening 24 to the opposite side of the member 22. The training aid 10 is thereby better secured on the user's hand.

When the training aid 10 is attached to the user's arm, the longitudinal slot 13 is disposed approximately parallel to the narrow length of the user's arm and is approximately aligned with the length of the user's thumb. The training aid 10 is worn on the left hand of a right-handed person.

Figure 3:
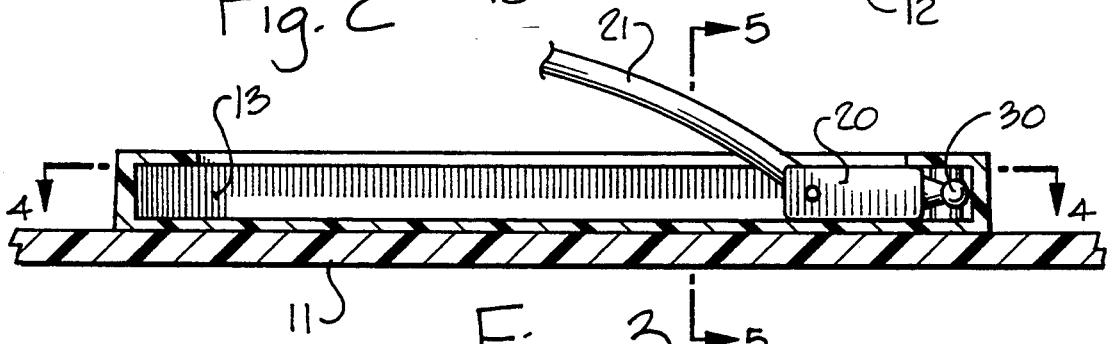
FIG. 3 is a cross-sectional view of the training aid of the present invention taken along the lines 3—3 of FIG. 2.
Figure 4:
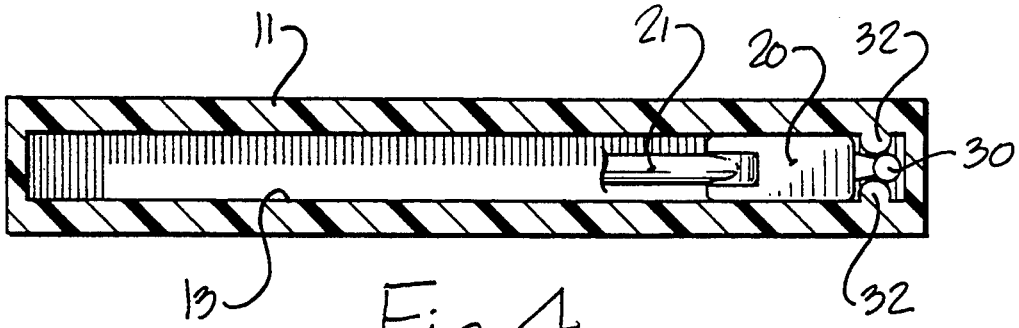
FIG. 4 is cross-sectional view of the housing of the present invention showing the sliding latch in the longitudinal slot taken along the lines 4—4 of FIG. 3.
Figure 5:
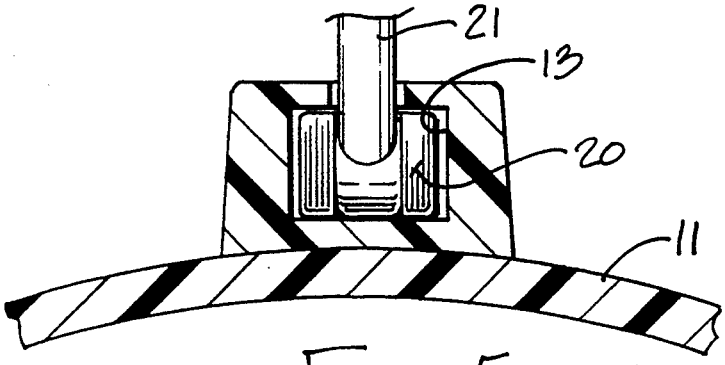
FIG. 5 is a cross-sectional view taken across the lines 5—5 of FIG. 3.
Figure 6:
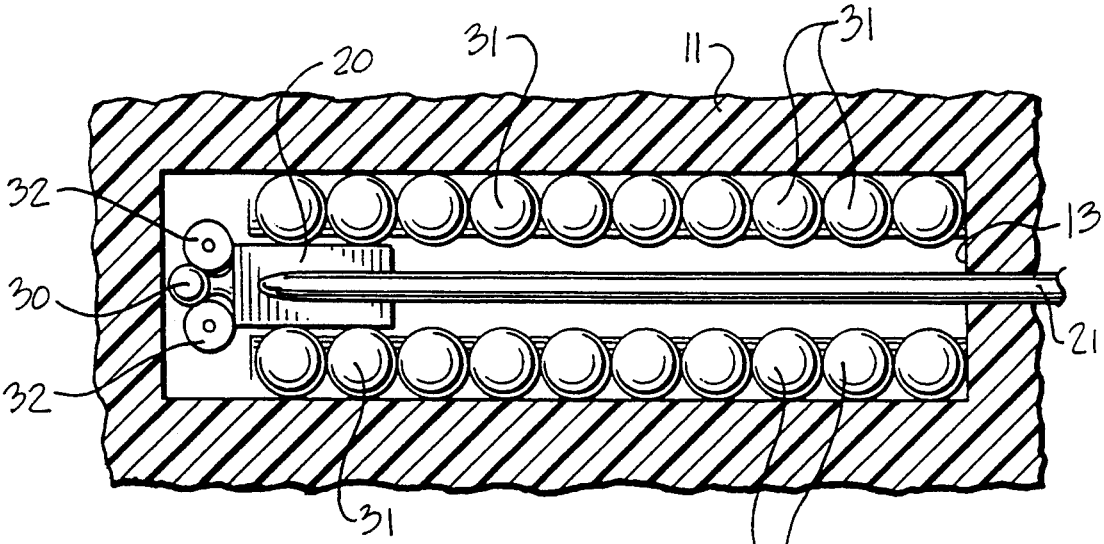
FIG. 6 is a cross-sectional view of the housing showing an alternate embodiment of the sliding latch in the longitudinal slot.

As seen in FIGS. 3–5, a stud 30 is formed on the sliding latch 20 and is oriented toward the back end 15 of the housing 11. To facilitate sliding movement of the sliding latch 20, a plurality of bearing means or rollers 31 may be disposed on the sides of the longitudinal slot 13. Alternately the sliding latch 20 may be lug made of a low friction material such as nylon which slides smoothly in the slot 13, as in FIG. 6. A socket 32 is formed in the back end of the longitudinal slot 13 at the end proximal to the back end 15 of the housing. When the sliding latch 20 is moved to the back end of the longitudinal slot, the stud 30 is removably received in the socket 32.

Thus, with the training aid 10 secured to the person's wrist and forearm by the strap means 12 and the person's thumb in the opening 24 in the pivotally attached member 22, when the stud 30 on the sliding latch 20 is held in the socket 32, the bowed connector 21 extends from the socket 32 to the swivel connecting means 25. Pivotal movement of the member 22 is thereby restrained and the person's wrist is restrained from bending or uncocking.

Figure 7A:
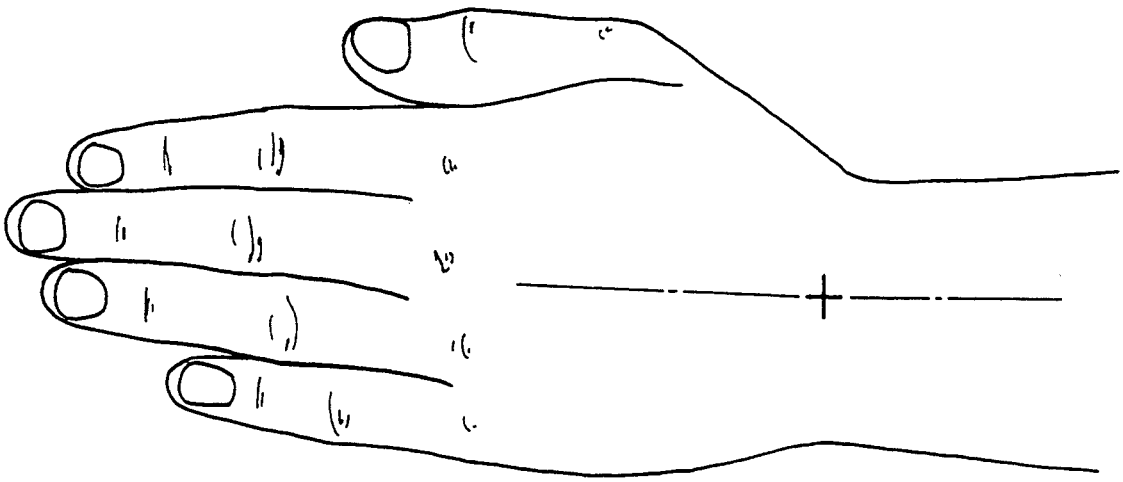
FIGS. 7A–7B are perspective views showing movement of the hand of the person.
Figure 7B:
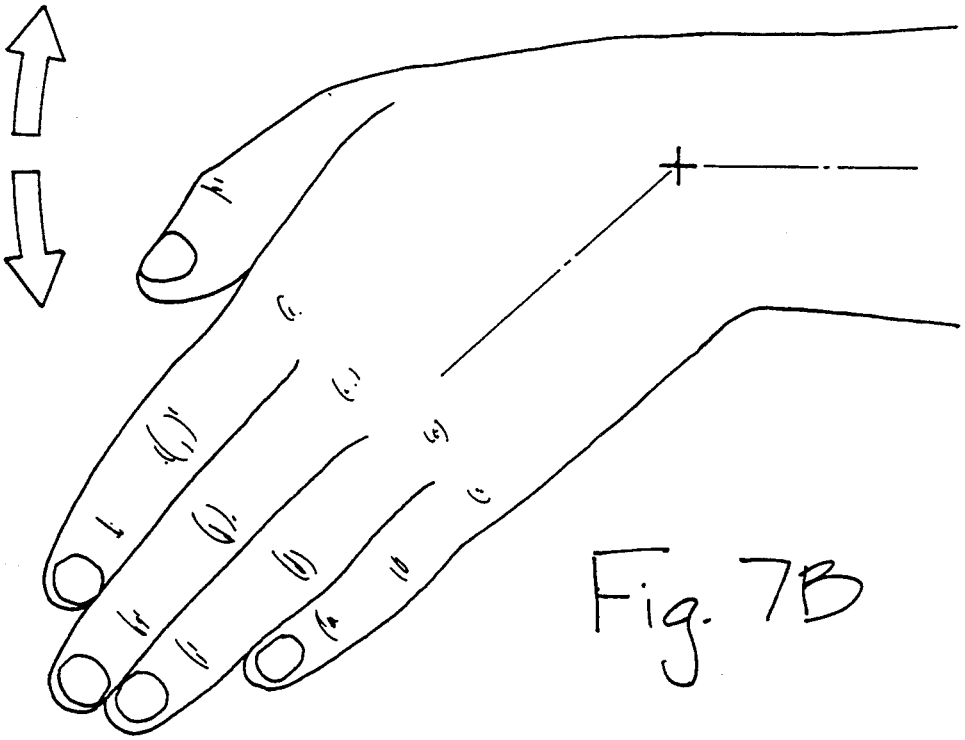

Referring to FIGS. 7A–7B, due to the location of the pivot 23, the movement of the person's hand with respect to the wrist is limited to side-to-side motion as shown by the arrows in FIG. 7B. Front to back movement of the hand with respect to the wrist is restricted. This side-to-side motion is the type of movement which is needed for proper swinging of a golf club.

Figure 8A:
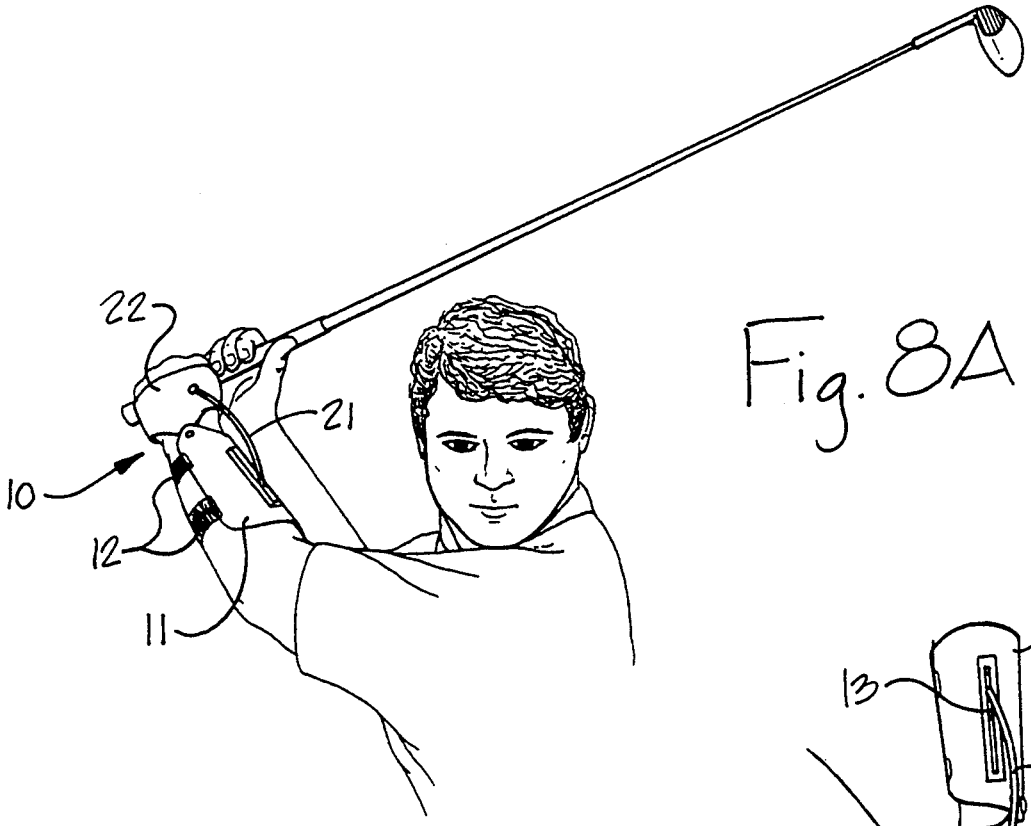
FIGS. 8A–8C are sequential perspective views showing the present invention controlling the bending of the wrists.
Figure 8B:
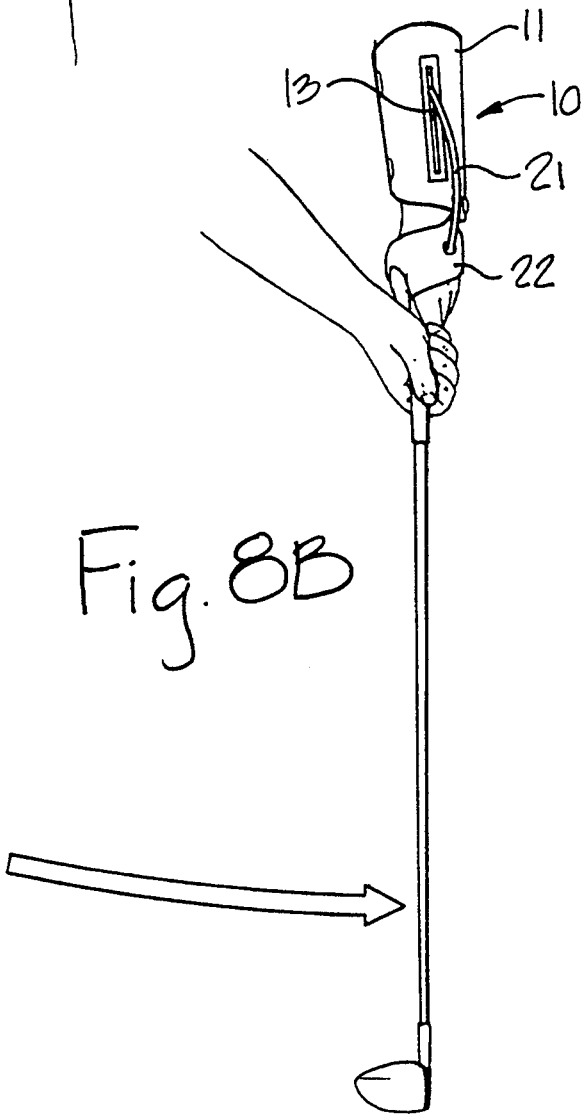
Figure 8C:
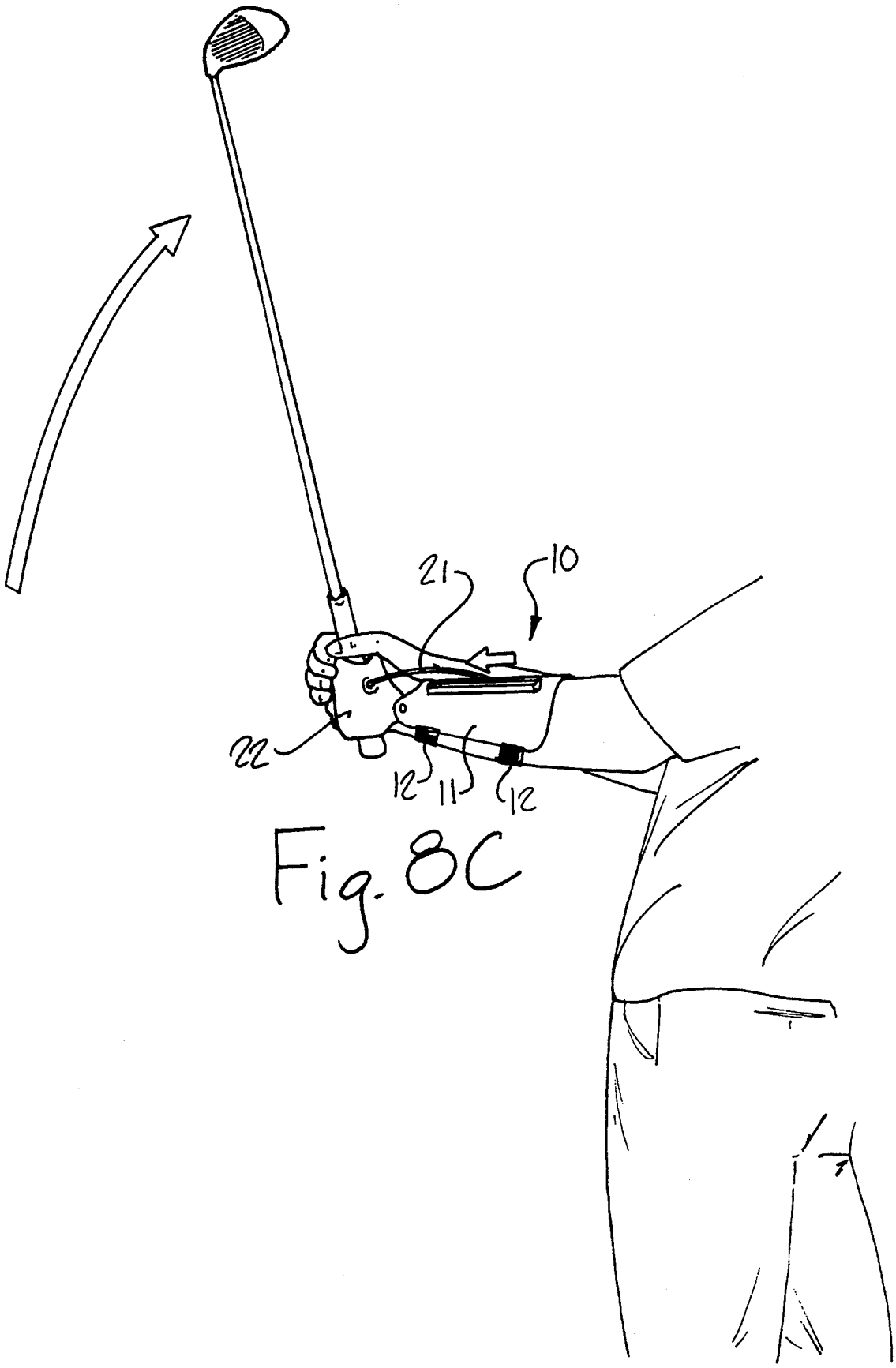

Referring to FIGS. 8A–8C, it can be seen that as a person holds the sporting implement in a position in preparation for swinging the sporting implement, the stud 30 is received in the socket 32 and the bowed connector 21 restrains movement of the pivotally attached member 22 in which the person's thumb is received. This limitation of movement of the thumb and the hand further restrains uncocking of the wrist. When the swing of the sporting implement brings the sporting implement closer to contact with the ball, gravity and centrifugal force uncock the wrist, the wrist bends and pulls the bowed connector 21 to release the stud 30 from the socket 32. The uncocking of the wrist occurs at a desired position close to impact of the sporting element with the ball due to the use of the training aid 10.

In this manner, the training aid 10 of the present invention controls the uncocking of the wrist and the person using the training aid learns the proper timing to bend the wrist to obtain maximum energy transfer to the ball.

The training aid of the present invention does not have a complex mechanism and can be fabricated from relatively noncostly materials without the need for sophisticated molds.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A training aid for persons using a hand-held sporting implement which strikes a ball, wherein the cocking of the wrists of the person is to be controlled, the training aid comprising: a housing, strap means connected to the housing for removably and adjustably securing the housing to the wrist and forearm of the person, the housing having a length, a front end and a back end, a longitudinal slot formed on the housing extending between the front end and the back end, a sliding latch slidably guided in the longitudinal slot, a stud formed on the sliding latch and oriented toward the back end of the housing, a socket formed in the longitudinal slot near the back end of the housing, a rigidbowed connector having a first end and a second end, said first end being connected to the sliding latch, a member pivotally attached to the front end of the housing, an opening being formed in the member wherein a thumb of the person's hand may be received in said opening when the housing is secured to the person's wrist and forearm, a swivel connecting means carried by the pivotally attached member, a second end of the bowed connector being connected to the swivel connecting means such that when the training aid is mounted on the person's hand, wrist and forearm and the person holds the sporting implement in a position to swing the sporting implement, the stud is received in the socket and the bowed connector restrains movement of the pivotally attached member in which the thumb is received thereby obtaining a desired setting of the wrist; and when the person swings the sporting implement, the desired setting of the wrist is maintained until the wrist uncocks and pulls the bowed connector to release the stud from the socket close to impact of the sporting element with the ball.

2. The training aid of claim 1, further comprising bearing means disposed in the longitudinal slot to facilitate sliding of the latch within the slot.

3. The training aid of claim 1, wherein the strap means have hook and loop fasteners thereon.

4. The training aid of claim 1, wherein the sporting implement is a golf club.

5. The training aid of claim 1, wherein the sporting implement is a baseball bat.

6. A training aid for persons using a hand-held sporting implement which strikes a ball, wherein the cocking of the wrists of the person is to be controlled, the training aid comprising: a housing to be removably secured to the wrist and forearm of the person, sliding latch means formed in the housing, means for releasably retaining the sliding latch means within the housing, a member pivotally attached to the housing, the member adapted to receive therein a thumb of the person, a bowed connector connecting the sliding latch means to the pivotally attached member such that when the training aid is mounted on the person's hand, wrist and forearm and the person holds the sporting implement in a position to swing the sporting implement, the sliding latch means is retained in the housing and the bowed connector restrains movement of the pivotally attached member in which the thumb is received thereby restraining uncocking of the wrist, and when the person swings the sporting implement close to impact with the ball, the wrist uncocks and pulls the bowed connector to release the sliding latch means.

* * * * *